United States Patent [19]

Baird

[11] 4,176,421

[45] Dec. 4, 1979

[54] SUDS-MAKING AND APPLYING KIT FOR CONVERTING UPRIGHT VACUUM SWEEPERS TO RUG SHAMPOOERS

[76] Inventor: Thomas E. Baird, 2132 N. 24th St., Springfield, Ill. 62702

[21] Appl. No.: 945,447

[22] Filed: Sep. 25, 1978

[51] Int. Cl.[2] ..... A47L 11/34

[52] U.S. Cl. ..... 15/320; 15/50 C; 15/328

[58] Field of Search ..... 15/50 R, 50 A, 50 C, 15/320, 321, 328

[56] References Cited

U.S. PATENT DOCUMENTS

| | | | |
|---|---|---|---|
| 2,293,722 | 8/1942 | Erickson | 15/320 |
| 2,575,675 | 11/1951 | Morgan | 15/320 X |
| 3,370,315 | 2/1968 | MacFarland et al. | 15/50 C X |

*Primary Examiner*—Christopher K. Moore
*Attorney, Agent, or Firm*—Ralph F. Staubly

[57] ABSTRACT

A suds-making device is attachable to the air-discharge port of an upright vacuum sweeper. A shampooing unit is easily attachable to the front of the vacuum sweeper in place of its easily removed suction-nozzle and rotating-brush unit. The shampooing unit has its own rotatable brush, similarly belt-driven by the sweeper motor, and also has a forwardly positioned transversely elongated tray to receive the applied and then scraper-blade-removed suds. The suds-making device and the shampooing unit (both of known construction) are interconnected by a detachable flexible hose. Importantly, the sudser end of the hose has attachable thereto, or molded thereon, a friction-held slip-on cap for closing the outlet port of the sudser, to stop suds flow. This cap arrangement serves two purposes: (1) preventing loss or misplacement of a separate closure cap, and (2) fastening the sudser end of the hose so that the hose need not be completely removed to prevent its flopping around during suds pick-up subsequent to suds application.

7 Claims, 7 Drawing Figures

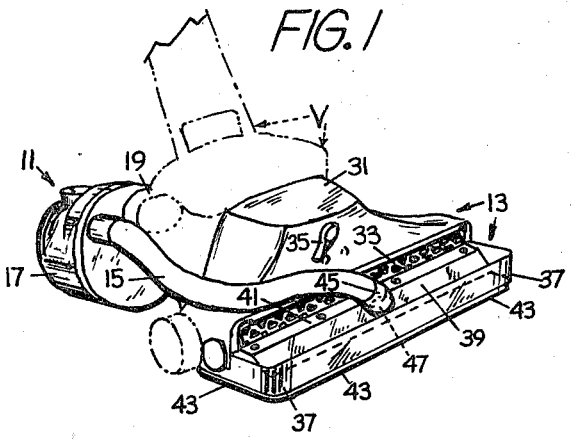
FIG. 1
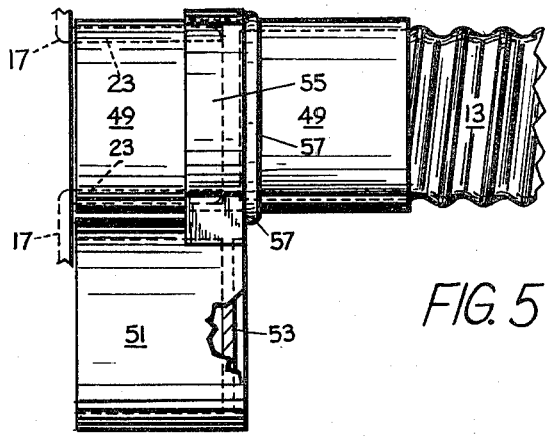
FIG. 5
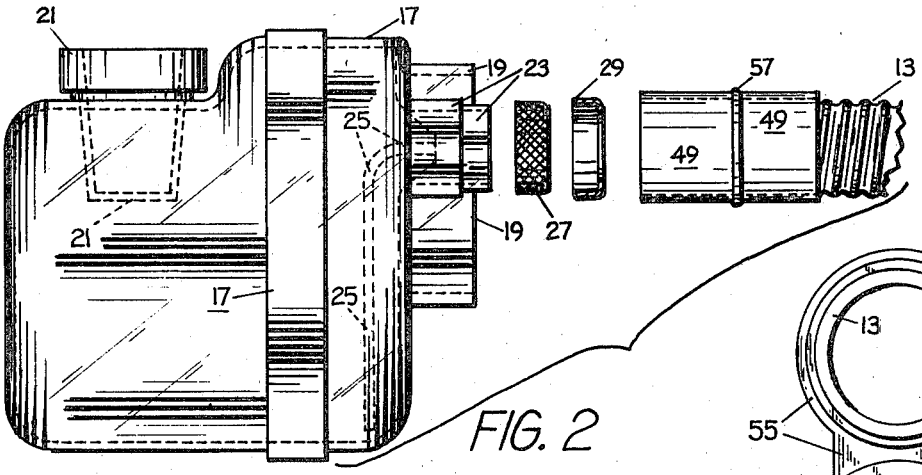
FIG. 2
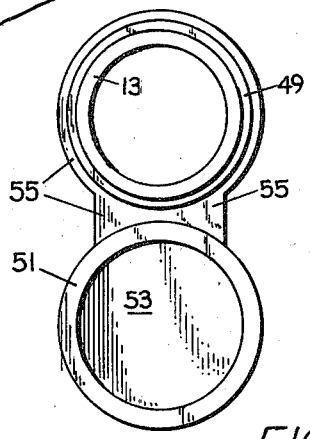
FIG. 6
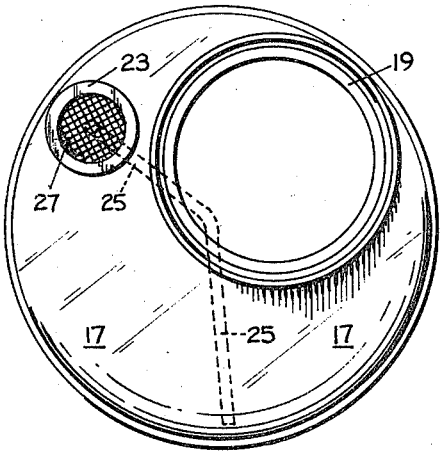
FIG. 3
FIG. 7
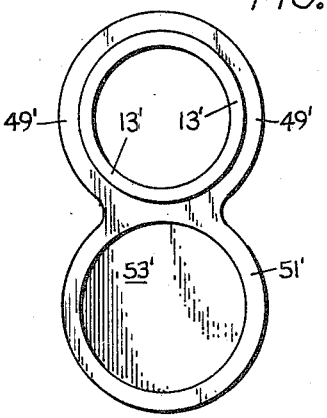
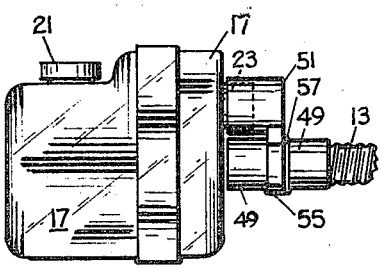
FIG. 4

SUDS-MAKING AND APPLYING KIT FOR CONVERTING UPRIGHT VACUUM SWEEPERS TO RUG SHAMPOOERS

BACKGROUND AND OBJECTS OF THE INVENTION

During suds pick-up it is desirable to be able to cut-off suds application easily and simply, as by capping the suds-outlet nipple. But a cap would be easily misplaced or lost, and the disconnected suds-receiving end of the flexible hose would objectionably flop around as the shampooer is reciprocated. It is accordingly the principal object of this invention to provide a cap integral with or attachable to the sudser end of the hose both to cap the sudser and also to anchor the hose end against flopping.

BRIEF DESCRIPTION OF THE DRAWINGS

FIG. 1 is a perspective view of the (prior-art) kit attached to a vacuum sweeper.

FIG. 2 is an enlarged side elevational view of the sudser part of the kit (minus the cap feature).

FIG. 3 is a front elevational view of the disclosure of FIG. 2.

FIG. 4 is a reduced-scale side elevational view showing the clip-on species of the cap in sudser-capping position.

FIG. 5 is an enlarged side elevational view of the cap of FIG. 4 in a non-capping position.

FIG. 6 is an end view of the showing of FIG. 5 viewed from the left of FIG. 5.

FIG. 7 is an end view similar to FIG. 6 but showing a modified cap molded integrally with the nipple-coupling sleeve on the hose.

DETAILED DESCRIPTION

With reference first to FIG. 1, the letter V generally designates the basic structure of an upright vacuum sweeper of known construction, which is herein shown converted to a rug shampooer by an attachable kit comprising a suds-making unit 11, a two-unit shampooing assemblage 13, and an interconnecting flexible hose 15, all of known constructions.

The sudser 11 comprises a reservoir 17 molded of plastic material and having an air-inlet port to be telescopically coupled to the air-discharge port of the sweeper V by an integral annular flange 19. A filling opening is closed by a stopper 21 in the shape and size of a cup, for measuring detergent material. An integrally molded nipple 23 has axially centered therein by radially positioned fingers, a small tube 25. Air pressure from the sweeper's blower (not shown) forces detergent solution upwardly and forwardly through the tube 25 and forces air past the tube-centering fingers for suds-forming discharge through an atomizing (and filtering) screen 27 clamped over the nipple end by an inwardly flanged ring 29.

The two-unit shampooer assemblage 13 comprises, first, a casting 31 to be connected to the front of the basic sweeper V by suitable means (not shown) after its rotary-brush-containing nozzle (not shown) has been removed. Casting 31 houses a cylindrical tufted brush 33 rotatable by the sweeper-motor shaft through a belt (both not shown). The belt is lifted and placed onto the motor shaft by a mechanism of known construction (not shown) by a rotatable knob 35.

Secondly, the shampooer assemblage 13 comprises a troughlike tray 37 for receiving spent suds and the dirt picked-up thereby. The upwardly and rearwardly sloping rear wall 39 of the tray 37 has a knife blade 41 fixed to its upper rearwardly flanged edge. The blade 41 scraps suds and dirt from the bristles of the rotating brush 35. A narrow rubber ribbon 43 depends from the periphery of the bottom of the tray 37 to define a shallow chamber thereunder to receive and to spreadout the suds forced thereinto through the flexible hose 15. The hose 15 is coupled to the under-the-tray chamber by a resilient-plastic sleeve 45 press-fitted into a circular aperture 47 in the sloping rear wall 39 of the tray 37.

The sudser end of the coil-spring re-inforced flexible hose 15 is screw-threadedly or otherwise fastened into one end of a resilient-plastic sleeve 49, the other end of which sleeve fits over and frictionally grips the nipple 23 of the sudser 11. In FIGS. 4–6 the cap 51 has a closure end wall 53 and a band 55 all integrally molded from resilient-plastic material so that the band 55 can be grippingly slipped onto the sleeve 49 up to its bead 57. Thus the sleeve 49 can be slipped onto the sudser nipple 23 for suds feeding, or the cap 51 can be slipped over the nipple 23 to cut-off suds feeding and simultaneously anchor the hose sudser-end against flopping around.

In FIG. 7, the sleeve 49' and the cap 51' are shown as being a one-piece integrally molded unit. Other primed numerals indicate parts corresponding to parts having the same numerals, not primed, in FIGS. 4–6.

The invention having been described, what is claimed is:

1. In an upright vacuum sweeper converted into a rug-type shampooer (1) by having its rotary-brush-type suction-nozzle replaced by a shampooer unit, (2) by having its dust bag replaced by a suds-maker operatively connected to the air-discharge port of said sweeper and including a suds-discharge nipple, and (3) by having a flexible hose interconnecting said suds-maker and said shampooer unit, the suds-maker end of said flexible hose having a frictionally coupling resilient sleeve easily removably engageable over said nipple, the improvement comprising: a suds-flow-stopping cap engageable over and frictionally retainable on said nipple, said cap being attached to said sleeve, whereby loss or replacement of said cap is prevented and whereby the suds-maker end of said hose can by said cap be fastened against flopping during shampooing motions.

2. Structure according to claim 1, said sleeve and said cap being integrally formed.

3. Structure according to claim 2, the integral formation being by unitary simultaneous molding.

4. Structure according to claim 1, said cap including means for easily detachably connecting said cap to said sleeve.

5. Structure according to claim 4, said means being resilient and integral with said cap and embracingly engageable with said sleeve.

6. Structure according to claim 4, said means being a resilient band fixed to said cap and grippingly slidable onto said sleeve.

7. Structure according to claim 6, said resilient band being integrally molded with said cap.

* * * * *